US009739564B2

(12) United States Patent
Nachefski

(10) Patent No.: US 9,739,564 B2
(45) Date of Patent: Aug. 22, 2017

(54) EFFICIENT HIGH-VELOCITY COMPRESSED GAS-POWERED GUN

(71) Applicant: William S. Nachefski, Katy, TX (US)

(72) Inventor: William S. Nachefski, Katy, TX (US)

( * ) Notice: Subject to any disclaimer, the term of this patent is extended or adjusted under 35 U.S.C. 154(b) by 0 days.

(21) Appl. No.: 15/340,681

(22) Filed: Nov. 1, 2016

(65) Prior Publication Data

US 2017/0045328 A1 Feb. 16, 2017

Related U.S. Application Data

(63) Continuation of application No. 14/551,833, filed on Nov. 24, 2014, now abandoned.

(51) Int. Cl.
*F41B 11/72* (2013.01)
*F41B 11/721* (2013.01)
*F41B 11/62* (2013.01)

(52) U.S. Cl.
CPC ..... *F41B 11/721* (2013.01); *F41B 11/62* (2013.01)

(58) Field of Classification Search
CPC ..... F41B 11/00; F41B 11/64; F41B 11/642; F41B 11/644; F41B 11/647; F41B 11/72; F41B 11/721; F41B 11/73
USPC ..... 102/56, 60, 61, 70, 71, 72, 73
See application file for complete search history.

(56) References Cited

U.S. PATENT DOCUMENTS 2,818,056 A * 12/1957 Martin ..... F41B 11/62 124/37
4,936,282 A * 6/1990 Dobbins ..... F41B 11/723 124/73
5,257,614 A * 11/1993 Sullivan ..... F41B 11/00 124/73
5,265,582 A * 11/1993 Bhogal ..... F41B 11/724 124/73
5,339,791 A * 8/1994 Sullivan ..... F41B 11/00 124/73
5,383,442 A * 1/1995 Tippmann ..... F41A 29/02 124/73
5,586,545 A * 12/1996 McCaslin ..... F41B 11/62 124/70
5,634,456 A * 6/1997 Perrone ..... F41B 11/721 124/31
5,724,954 A * 3/1998 Smith ..... F41B 11/642 124/66

(Continued)

*Primary Examiner* — Derrick Morgan
(74) *Attorney, Agent, or Firm* — Howard L. Speight, PLLC

(57) ABSTRACT

An efficient high-velocity compressed gas-powered gun includes a lower receiver having a trigger assembly. The efficient high-velocity compressed gas-powered gun includes an upper receiver having a gas distribution assembly and a bolt assembly configured to operate in response to actuation of the trigger assembly and configured to be operated by the gas distribution system. The bolt assembly has a first part and a second part that are separated by a small gap just prior to actuation of the trigger assembly, and become separated by a large gap, larger than the small gap, over a projectile-firing period of time immediately after the trigger assembly is actuated. The increase in the gap size is caused by movement of the second part in response to gas entering the small gap from the gas distribution assembly. The first part and the second part move together to cock the gun once they are separated by the large gap.

21 Claims, 8 Drawing Sheets

(56) References Cited

U.S. PATENT DOCUMENTS 5,771,875 A * 6/1998 Sullivan ..... F41B 11/721 124/72
5,778,868 A * 7/1998 Shepherd ..... F41B 11/723 124/73
5,913,303 A * 6/1999 Kotsiopoulos ..... F41B 11/724 124/31
6,024,077 A * 2/2000 Kotsiopoulos ..... F41B 11/724 124/71
6,286,497 B1 * 9/2001 Levkov ..... F41B 11/723 124/73
6,532,949 B1 * 3/2003 McKendrick ..... F41B 11/57 124/73
6,550,468 B1 * 4/2003 Tippmann, Jr. ..... F41B 11/721 124/31
7,451,756 B2 * 11/2008 Tippmann, Jr. ..... F41A 21/00 124/74
7,770,571 B2 * 8/2010 Tippmann, Jr. ..... F41B 11/00 124/73
7,836,872 B2 * 11/2010 Tseng ..... F41A 19/33 124/31
7,861,702 B1 * 1/2011 Sze ..... F41B 11/56 124/73
7,931,018 B1 * 4/2011 Lai ..... F41B 11/721 124/71
8,261,728 B1 * 9/2012 Tseng ..... F41B 11/55 124/73
8,286,622 B2 * 10/2012 Halmone ..... F41A 3/14 124/74
8,430,085 B2 * 4/2013 Tippmann, Sr. ..... F41B 11/00 124/48
8,464,454 B2 * 6/2013 Martin ..... F41A 3/66 124/70
8,578,921 B2 * 11/2013 Macy ..... F41B 11/62 124/73
8,925,539 B2 * 1/2015 Rice ..... B23P 6/00 124/73
9,658,027 B2 * 5/2017 Stevens ..... F41B 11/71
2002/0002785 A1 * 1/2002 Tippmann, Jr. ..... F41A 21/00 42/76.01
2003/0047175 A1 * 3/2003 Farrell ..... F41A 11/06 124/76
2003/0230296 A1 * 12/2003 Farrell ..... F41B 11/721 124/73
2004/0065310 A1 * 4/2004 Masse ..... F41B 11/57 124/75
2005/0188977 A1 * 9/2005 Wygant ..... A63B 69/409 124/73
2006/0000510 A1 * 1/2006 Henley ..... F16K 1/305 137/495
2006/0162716 A1 * 7/2006 Dobbins ..... F41A 19/12 124/77
2007/0151548 A1 * 7/2007 Long ..... F41B 11/721 124/73
2007/0181117 A1 * 8/2007 Tippmann, Jr. ..... F41B 11/00 124/74
2007/0209650 A1 * 9/2007 Jones ..... F41B 11/721 124/73
2008/0078971 A1 * 4/2008 Quinn ..... F41B 11/724 251/205
2008/0127959 A1 * 6/2008 Gan ..... F41B 11/721 124/75
2008/0173291 A1 * 7/2008 Halmone ..... F41B 11/721 124/77
2008/0190275 A1 * 8/2008 Tippmann ..... F41A 1/04 89/7
2009/0145413 A1 * 6/2009 Li ..... F41B 11/724 124/73
2009/0194088 A1 * 8/2009 Tippmann, Jr. ..... F41A 11/00 124/74
2009/0255523 A1 * 10/2009 Lian ..... F41B 11/721 124/73
2009/0260610 A1 * 10/2009 Walker ..... F41B 11/721 124/73
2010/0101550 A1 * 4/2010 Carnall ..... F41A 3/12 124/76
2010/0212648 A1 * 8/2010 Tseng ..... F41B 11/73 124/39
2010/0224180 A1 * 9/2010 Tippmann, Jr. ..... F41A 35/00 124/74
2010/0282231 A1 * 11/2010 Chen ..... F41B 11/72 124/73
2011/0048395 A1 * 3/2011 Maeda ..... F41B 11/62 124/76
2011/0088675 A1 * 4/2011 Wood ..... F41B 11/721 124/73
2011/0120437 A1 * 5/2011 Tippmann, Jr. ..... F41B 11/55 124/74
2011/0186026 A1 * 8/2011 Tippmann, Sr. ..... F41B 11/00 124/73
2012/0255534 A1 * 10/2012 Cole ..... F41B 11/52 124/77
2012/0318251 A1 * 12/2012 Tseng ..... F41B 11/62 124/73
2013/0186383 A1 * 7/2013 Chen ..... F41B 11/721 124/61
2013/0263840 A1 * 10/2013 Maeda ..... F41B 11/721 124/76
2014/0026878 A1 * 1/2014 Jones ..... F41B 11/721 124/75
2014/0096757 A1 * 4/2014 Larmer ..... F41B 11/52 124/73
2014/0305419 A1 * 10/2014 Liao ..... F41B 11/721 124/73
2014/0338649 A1 * 11/2014 Williams ..... F41B 11/721 124/73
2015/0253102 A1 * 9/2015 Macy ..... F41B 11/643 124/76
2016/0047620 A1 * 2/2016 Tseng ..... F41B 11/721 124/65
2016/0047621 A1 * 2/2016 Sullivan ..... F41B 11/721 124/73
2016/0146567 A1 * 5/2016 Nachefski ..... F41B 11/62 124/73
2017/0153081 A1 * 6/2017 Hu ..... F41B 11/642
2017/0160046 A1 * 6/2017 Shen ..... F41B 11/723

* cited by examiner

EFFICIENT HIGH-VELOCITY COMPRESSED GAS-POWERED GUN

CROSS-REFERENCE TO RELATED APPLICATION

This application is a continuation of U.S. application Ser. No. 14/551,833, filed Nov. 24, 2014, which is hereby incorporated by reference.

TECHNICAL FIELD

Embodiments of the invention are directed, in general, to compressed gas-powered guns and, more specifically, to an efficient high-velocity compressed gas-powered gun.

BACKGROUND

A variety of configurations of projectile guns, such as BB guns and pellet guns, exist. Some configurations are spring-loaded and use the mechanical energy of a spring to eject the projectile at a high rate of speed. Other configurations rely on compressed gas as the power source for ejecting the projectile from a barrel of the gun. Projectile guns exist in rifle configurations and pistol or handgun configurations. Additionally, there are currently single-shot configurations, semi-automatic configurations, and fully automatic configurations in existence.

Most compressed-gas guns use the compressed gas inefficiently. Previous designs of compressed-gas projectile guns are often lossy, or use more compressed-gas used with each shot than needed. Gas use efficiency is important, particularly for guns that operate on CO2 cartridges, and for automatic and semi-automatic guns. Gas losses can reduce the operation time on a compressed gas power source, and can increase cost of use.

SUMMARY

Embodiments of efficient high-velocity compressed gas-powered guns are described. In an embodiment, the gas-powered gun includes a lower receiver having a trigger assembly. The gas-powered gun may also include an upper receiver having a bolt assembly configured to operate in response to actuation of the trigger assembly, and a gas distribution assembly coupled to the bolt assembly, the gas distribution assembly configured to actuate the bolt assembly with a portion of gas used to fire a projectile.

In an embodiment, the trigger assembly includes a drop sear configured to at least partially rest on a surface of a shelf sear, the shelf sear being coupled to a trigger lever. In such an embodiment, the trigger assembly may also include an auto sear configured to engage a portion of the drop sear to cause the trigger assembly to fire repeatedly until the trigger lever is released. Additionally, such an embodiment may include a fire mode selector switch configured to cause the auto sear to engage and disengage the drop sear. Additionally, the fire mode selector switch may be configured to be a safety selector switch, wherein when a safety mode is selected, the fire mode selector switch prevents the gun from firing. In an embodiment, the trigger assembly further comprises a valve striker configured to strike a valve stem for releasing compressed air from a high pressure chamber and discharging the gun. In such an embodiment, the drop sear is configured to engage the valve striker, and to release the valve striker in response to actuation of the trigger assembly.

In an embodiment, the bolt assembly further comprises a bolt carrier group. In one embodiment, the bolt carrier group may include a bolt lock piston. The bolt carrier group may further include a bolt lock regulator body. In such an embodiment, the bolt lock regulator body may include a bolt lock regulator poppet. The bolt carrier group may also include a bolt probe configured to receive a portion of the compressed gas used to eject the projectile from the gun. In such an embodiment, the bolt lock regulator poppet receives compressed gas through the bolt probe for actuation of the bolt assembly. The bolt lock regulator poppet may be adjustable. Also, the bolt carrier group may include a bolt lock bushing. The bolt assembly may also include a bolt bushing configured to receive at least a portion of the bolt carrier group and allow actuation of one or more components of the bolt carrier group relative to the bolt bushing.

In an embodiment, the gas distribution assembly may include a high pressure chamber configured to receive compressed gas. The gas distribution assembly may also include a valve poppet configured to release the compressed gas in the high pressure port for ejecting the projectile from the gun. The gas distribution assembly may also include a valve stem coupled to the valve poppet, the valve stem configured to actuate the valve poppet in response to being struck by a valve striker. The valve poppet may be adjustable.

BRIEF DESCRIPTION OF THE DRAWINGS

Figure 1:
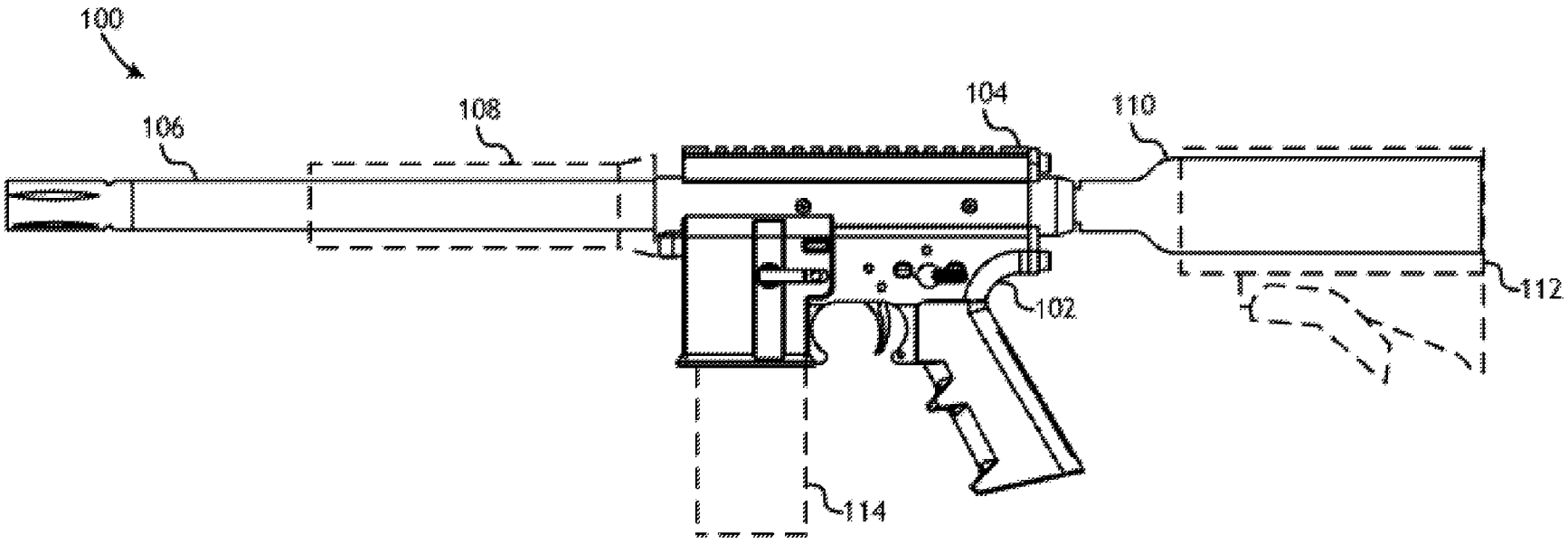

Having thus described the invention in general terms, reference will now be made to the accompanying drawings, which are not necessarily drawn to scale, and wherein:

FIG. 1 is a side view diagram illustrating one embodiment of an efficient high-velocity compressed gas-powered gun.

Figure 2:
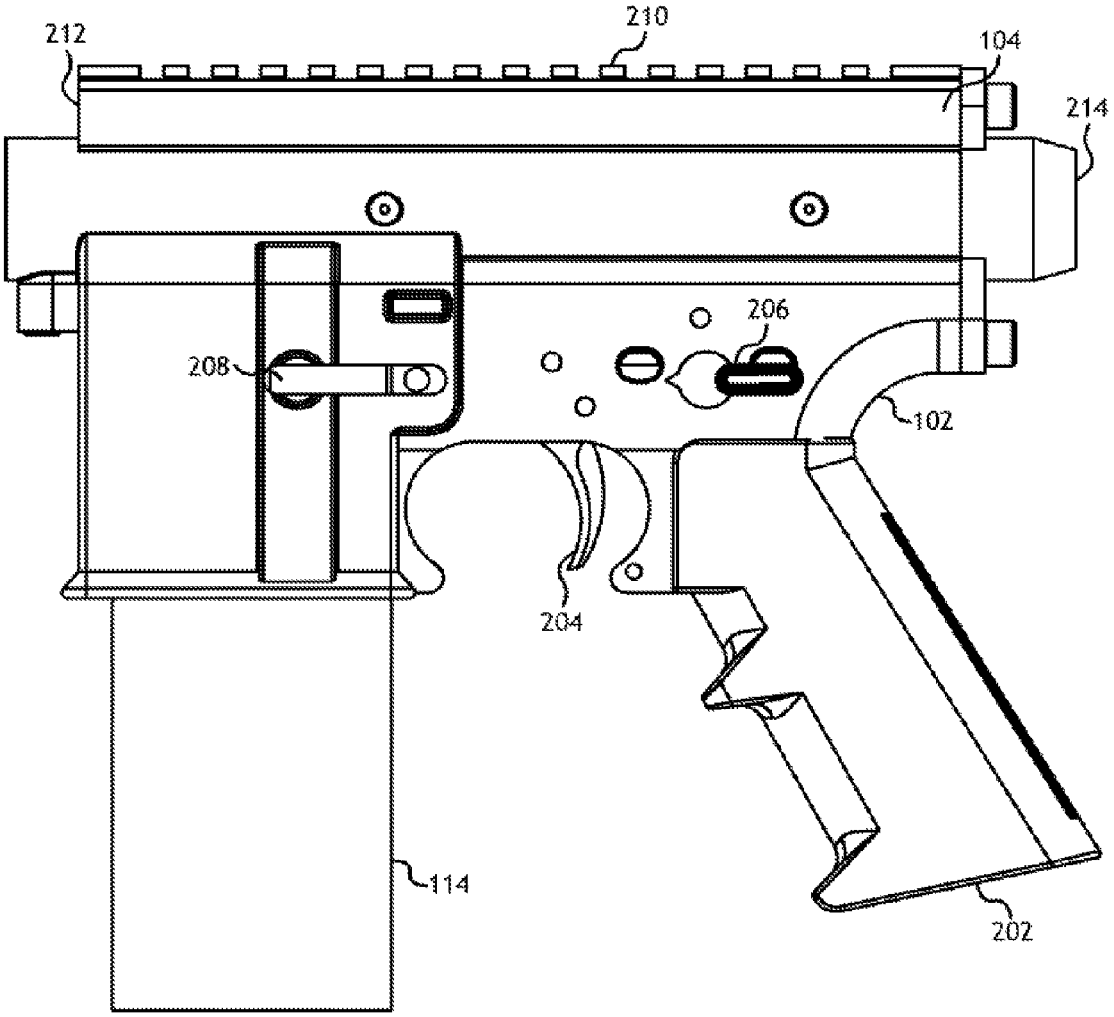

FIG. 2 is a side view diagram illustrating one embodiment of a receiver assembly of an efficient high-velocity compressed gas-powered gun.

Figure 3:
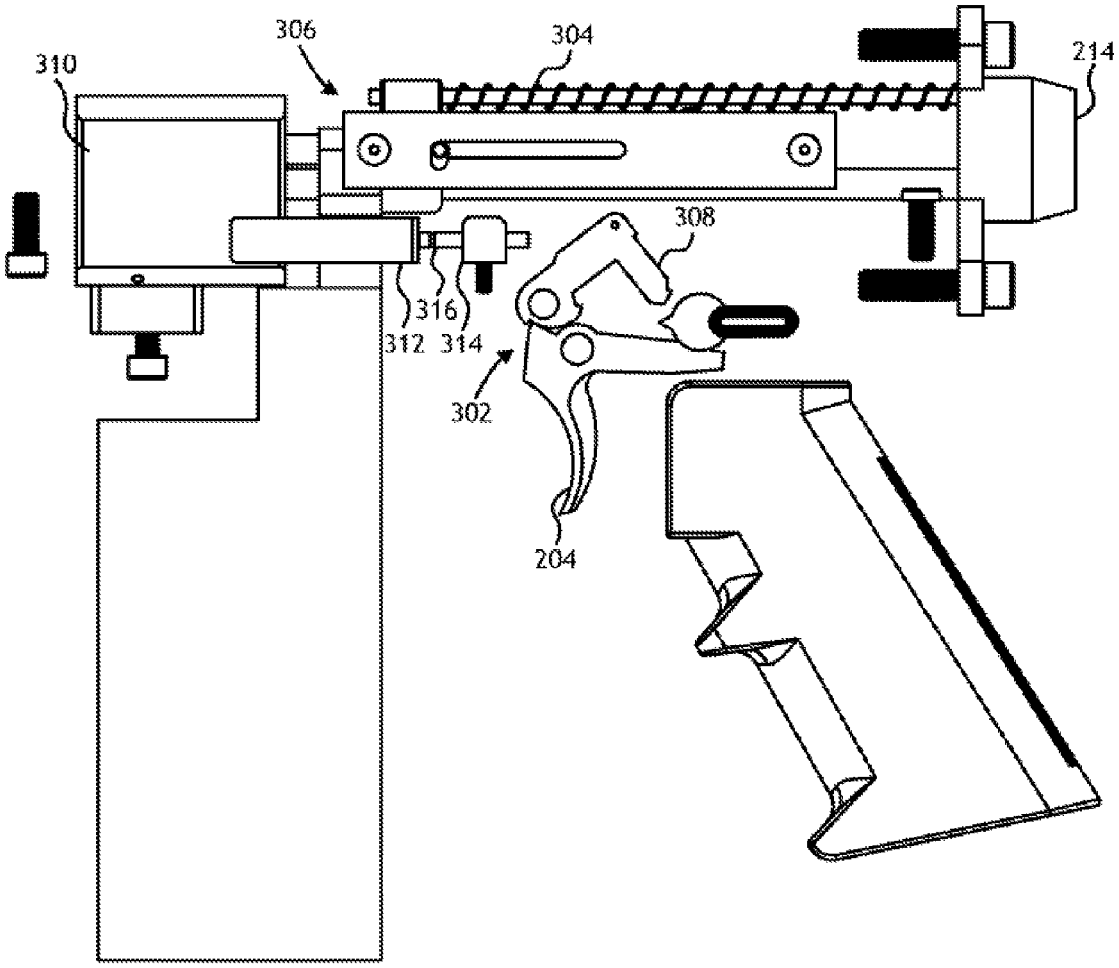

FIG. 3 is an internal view diagram illustrating one embodiment of an efficient high-velocity compressed gas-powered gun.

Figure 4:
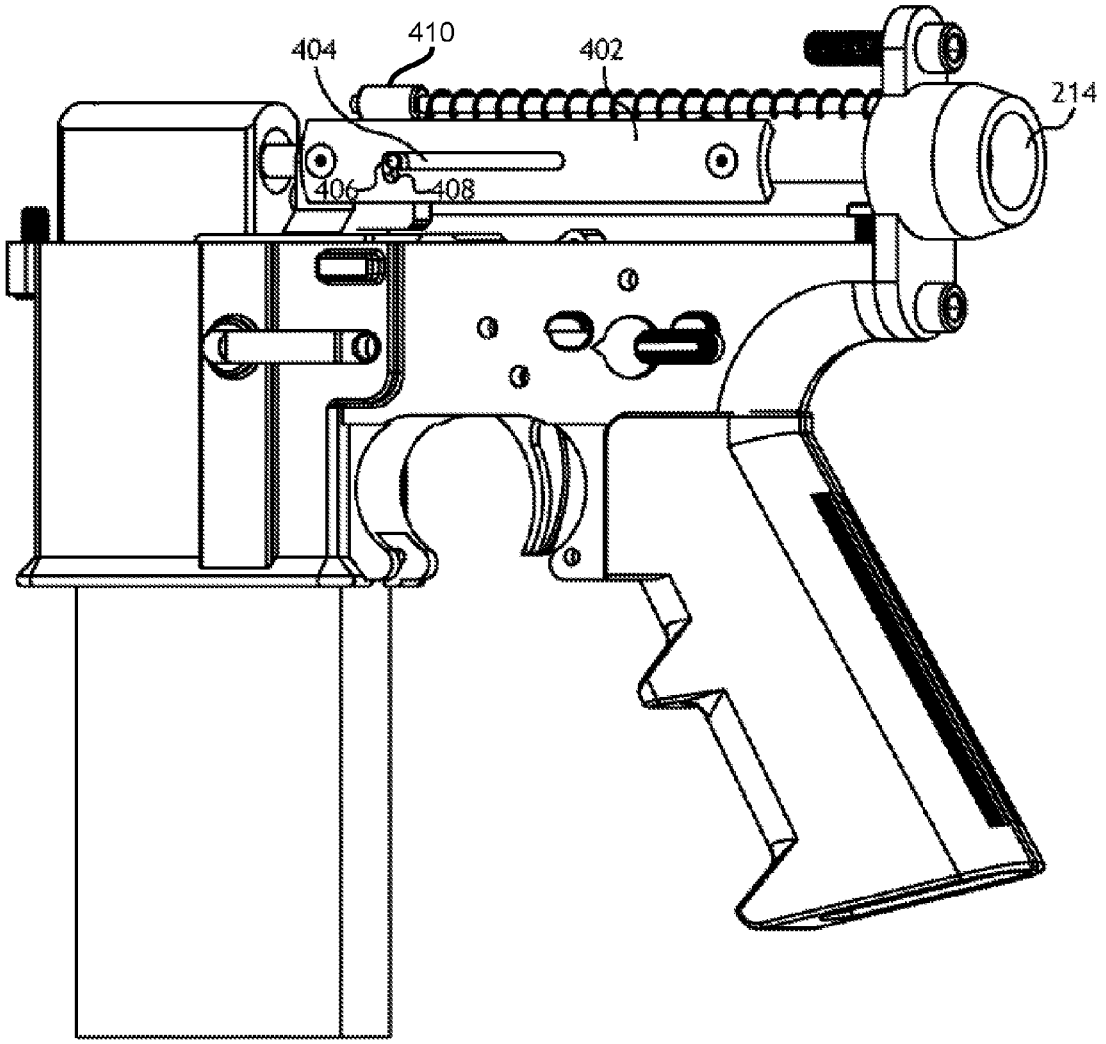

FIG. 4 is a perspective view diagram illustrating one embodiment of internal components of an upper receiver for an efficient high-velocity compressed gas-powered gun.

Figure 5:
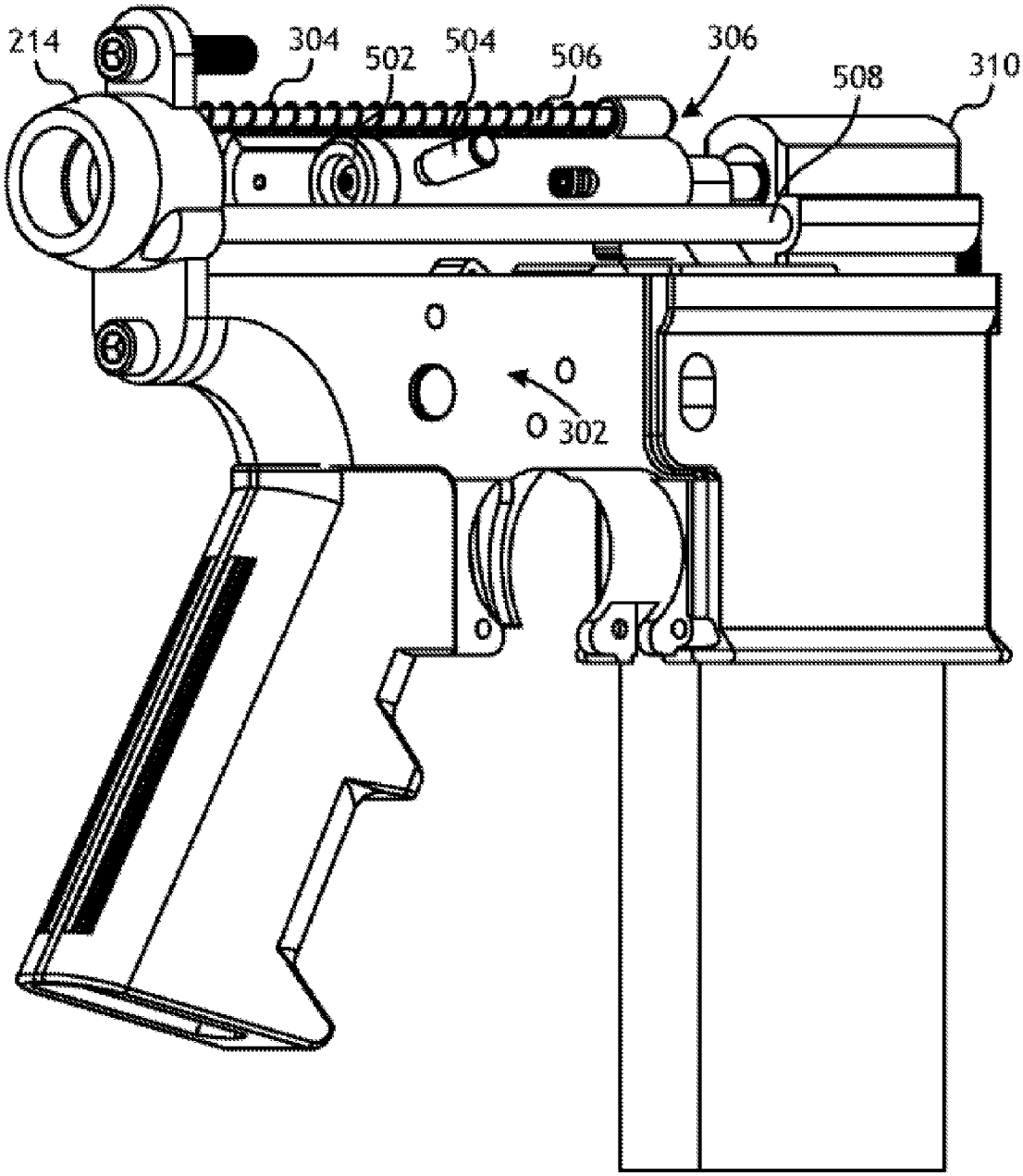

FIG. 5 is a perspective view diagram illustrating one embodiment of internal components of an upper receiver for an efficient high-velocity compressed gas-powered gun.

Figure 6:
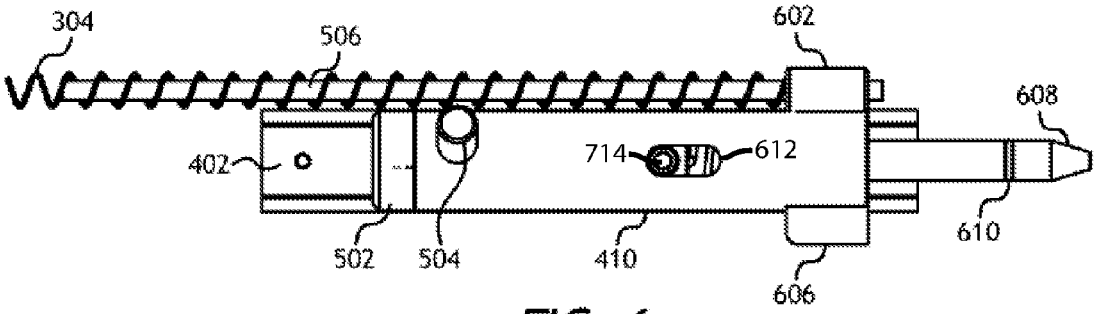

FIG. 6 is a side view diagram illustrating one embodiment of a bolt assembly of an efficient high-velocity compressed gas-powered gun.

Figure 7:
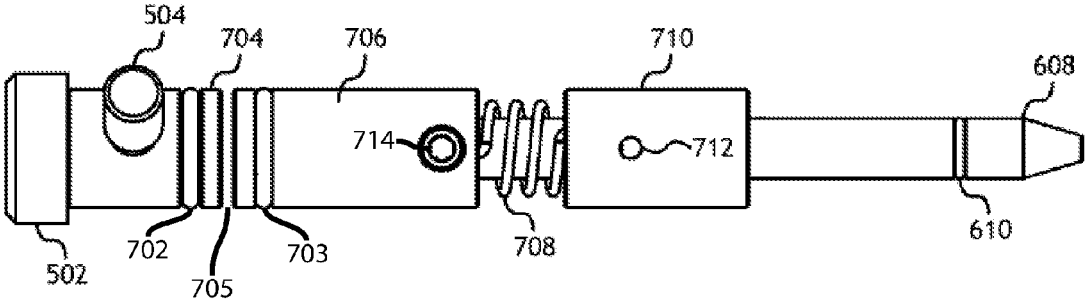

FIG. 7 is a side view diagram illustrating one embodiment of a bolt assembly of an efficient high-velocity compressed gas-powered gun.

Figure 8:
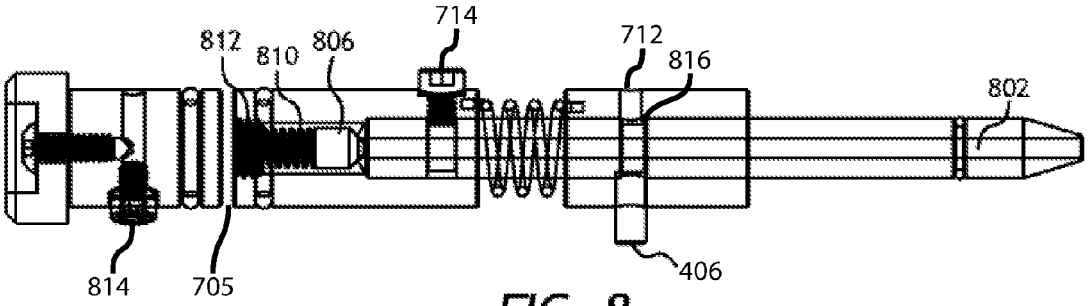

FIG. 8 is a cross-section view diagram illustrating one embodiment of a bolt assembly of an efficient high-velocity compressed gas-powered gun.

Figure 9:
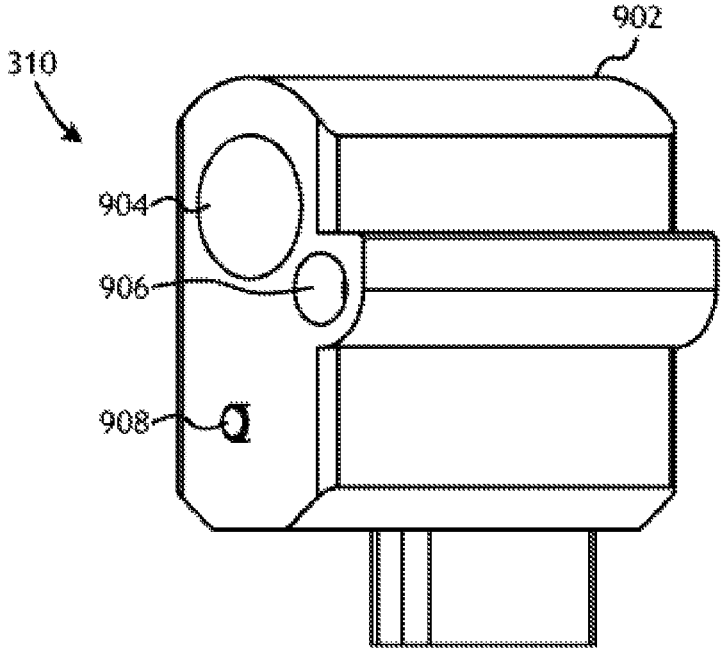

FIG. 9 is a perspective view diagram illustrating one embodiment of a gas distribution block assembly of an efficient high-velocity compressed gas-powered gun.

Figure 10:
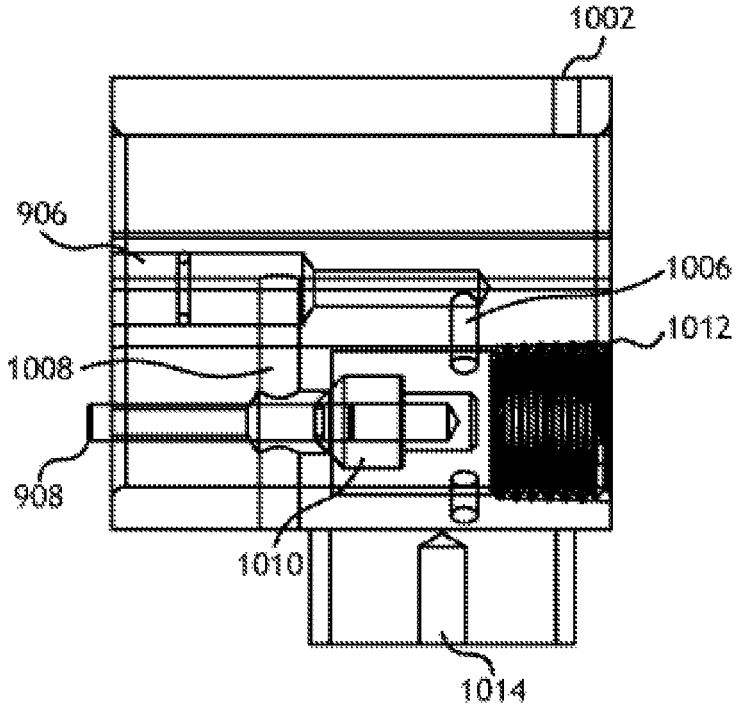

FIG. 10 is a cross-section view diagram illustrating one embodiment of a gas distribution block assembly of an efficient high-velocity compressed gas-powered gun.

Figure 11:
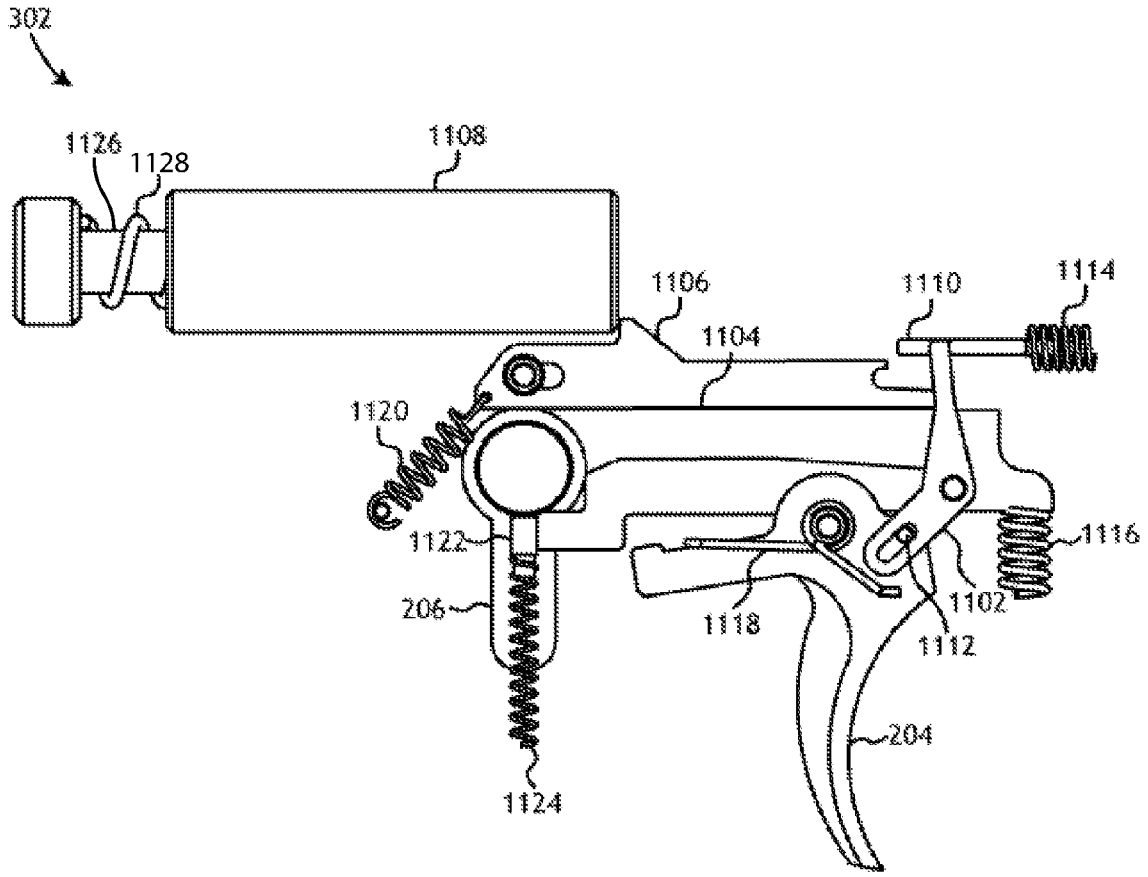

FIG. 11 is a side view diagram illustrating one embodiment of a trigger assembly of an efficient high-velocity compressed gas-powered gun.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

FIG. 1 is a side view diagram illustrating one embodiment of an efficient high-velocity compressed gas-powered gun 100. In an embodiment the gun 100 includes a lower receiver 102 coupled to an upper receiver 104. Additionally, the gun 100 may include a compressed gas power source 110 and a barrel 106. Optionally, the gun 100 may include a hand guard 108 a butt stock 112, and other optional components, such as a magazine 114, flashlight (not shown), optics (not shown), etc.

FIG. 2 is a side view diagram illustrating one embodiment of a receiver assembly 200 of an efficient high-velocity compressed gas-powered gun. In an embodiment, the receiver assembly 200 includes an upper receiver 104 and a lower receiver 102. The upper receiver 104 may be coupled to the lower receiver 102. In certain embodiments, the upper receiver 104 may be detachable from the lower receiver 102. In still other embodiments, the upper receiver 104 may swivel or otherwise operate with reference to the lower receiver 102. In such embodiments, the upper receiver 104 may be coupled to the lower receiver 102 by one or more pins, hinges, or the like.

In an embodiment, a handle grip 202 may be coupled to the lower receiver 102. Additionally, the lower receiver 102 may include a fire-safety selector switch 206 and a trigger 204. In some embodiments, the lower receiver 102 may include a magazine retention or release device 208 for retaining and releasing the magazine 114 relative to the lower receiver 102.

In an embodiment, a gas power source adapter 214 may be coupled to the upper receiver 104 and configured to receive a gas power source 110, such as a compressed gas bottle. The upper receiver 104 may also include an accessory attachment rail 210. For example, the accessory attachment rail 210 may be a Mil-Spec Picatinny rail configured to receive optional optics, flashlights, laser targeting devices, flashlights, etc. The upper receiver 104 may also include a housing 212 for receiving a bolt assembly and gas distribution assembly as described further below.

FIG. 3 is an internal view diagram illustrating one embodiment of an efficient high-velocity compressed gas-powered gun 100. In an embodiment, the gun 100 may include a trigger assembly 302, a bolt assembly 306, and a gas distribution assembly 310. The gas power source adapter 214 may receive compressed gas from the gas power source 110. The gas may be used to operate the bolt assembly 306 in response to operation of the trigger assembly 302. The gas distribution assembly 310 may further utilize the gas to reset the bolt assembly 306 and/or reset the trigger assembly 302.

In an embodiment, the trigger assembly 302 may include a trigger 204 configured for manual actuation by a finger of a user. Additionally, the trigger assembly 302 may include a hammer 308 for catching and releasing the bolt assembly 306. The bolt assembly 306 may include a main spring 304 configured for mechanical actuation of the bolt assembly. The main spring 304 may be configured to provide a bias force to the bolt assembly 306 for biasing the bolt assembly 306 in a specific position. In an embodiment, the trigger assembly 302 may also include a striker linkage 312, coupled to a striker pin 316, which is coupled to a striker pin bushing 314. The striker linkage 312 may cause the gas distribution assembly 310 to release gas to fire a projectile and to reset the trigger assembly into a cocked position.

FIG. 4 is a perspective view diagram illustrating one embodiment of internal components of an upper receiver 104 for an efficient high-velocity compressed gas-powered gun 100. In an embodiment, the bolt assembly 306 includes a bolt bushing 402 with a cam lock slot 404. In an embodiment, a cam pin 406 coupled to a component within the bolt carrier 410 may slide within the cam lock slot 404. In some embodiments, the cam pin 406 may lock within a lock notch 408 in the cam lock slot 404. The trigger assembly 302 may actuate the cam pin 406 within the cam lock slot 404 to release the cam pin 406 from the lock notch 408, which may allow the bolt carrier 410 to move relative to the bolt bushing 402.

FIG. 5 is a perspective view diagram illustrating one embodiment of internal components of an upper receiver 104 for an efficient high-velocity compressed gas-powered gun 100. In an embodiment, the upper receiver 102 includes a gas power supply adapter 214 configured to receive gas from a gas power supply 110. In an embodiment, the gas may operate the bolt assembly 306. The bolt assembly may include a recoil buffer 502 coupled to the bolt carrier 410. The bolt assembly 306 may be coupled to the main spring 304 via spring guide 506. Additionally, a charging handle 504 may be coupled to the bolt carrier 410 for manual actuation of the bolt assembly 306. The gas distribution assembly 310 may be coupled to a gas transfer tube 508 configured to transfer gas for operation of the bolt assembly 306. The lower receiver 102 may include a trigger assembly 302 configured for release and retention of the bolt assembly 306 to cock and fire the gun 100.

FIG. 6 is a side view diagram illustrating one embodiment of a bolt assembly 306 of an efficient high-velocity compressed gas-powered gun 100. In an embodiment, the bolt assembly 306 includes a bolt bushing 402. The bolt carrier 410 may be configured to slide against a surface of the bolt bushing 402. The charging handle 504 may be used to cock the bolt assembly 306 by actuating the bolt carrier 410 relative to the bolt bushing 402 and compressing the main spring 304 along the spring guide 506. In an embodiment, the hammer cocking boss 606 may operate to cock the trigger assembly 302. Additionally, the bolt probe 608 may be inserted into a firing chamber by operation of the bolt assembly 306. The bolt probe O-ring 610 may seal the firing chamber, preventing leakage of air from the bolt probe 608.

FIG. 7 is a side view diagram illustrating one embodiment of a bolt assembly 306 of an efficient high-velocity compressed gas-powered gun 100. In an embodiment, the bolt assembly 306 includes a recoil buffer 502 configured to guard against damage from the bolt cycling within the upper receiver 104. Additionally, the bolt assembly 306 may include a charging handle 504. The charging handle 504 may be coupled to a bolt lock piston 704. The bolt lock piston 704 may be fixed to the bolt carrier 410 by a cap screw 814 shown in FIG. 8. The bolt assembly 306 may also include a bolt lock regulator body 706 that is fixed to the bolt lock probe 608 by a cap screw 714. In an embodiment, O-ring 702 may be coupled to the bolt lock piston 704 and piston ring 703 may be coupled to the bolt lock regulator body 706 to prevent leakage of gas from the bolt assembly 306. A bolt lock spring 708 may bias the bolt lock regulator body 706 apart from a bolt lock bushing 710 and, acting as a torsion spring, bias the bolt lock bushing 710 to rotate about the bolt probe 608. In an embodiment, a setscrew 712 may be coupled through the bolt lock bushing 710 and into a groove 816 in the bolt lock probe 608 (see FIG. 8). This arrangement prevents the bolt lock bushing 710 from moving laterally with respect to the bolt lock probe 608 but allows the bolt lock bushing 710 to rotate around the bolt lock probe 608.

FIG. 8 is a cross-section view diagram illustrating one embodiment of a bolt assembly 306 of an efficient high-velocity compressed gas-powered gun 100. In an embodiment, the bolt probe 608 may include a probe transfer port 802. In an embodiment, compressed gas may be directed through the probe transfer port 802. In some embodiments, the gas directed through the probe transfer port 802 may cause the bolt lock regulator poppet 806 to release compressed gas through a hollow bolt lock regulator adjustment screw 812 into a gap 705 between the bolt lock piston 704 and the bolt lock regulator body 706 causing the two bodies to separate by the distance the cap screw 714 can move in the slot 612 (see FIG. 6). The gap 705 increases from the small gap shown in FIGS. 7 and 8 to a large gap, which is larger than the gap 705 shown in FIGS. 7 and 8 by the length of the slot 612, in a projectile-firing period of time. During the projectile-firing period of time all of the gas, except that used to increase the size of the gap 705, is used to fire the projectile from the gun 100. Movement of the bolt lock piston 704 causes the bolt lock carrier 410 to translate relative to the bolt lock bushing 710. The translation of the bolt lock carrier 410 relative to the bolt lock bushing 710 and a cam interaction therebetween may cause the cam pin 406 to move upwardly from a position low in the lock notch 408 (see FIG. 4) into the cam lock slot 404. The upward movement of the cam pin 406 causes the bolt lock bushing 710 to rotate relative to the bolt lock regulator body 706, which rotation is resisted by the torsion spring 708. Once the cam pin 406 enters the cam lock slot 404, which occurs after the projectile-firing period of time, the entire bolt assembly 306, including the bolt lock piston 704, the bolt lock regulator body 706, the bolt lock bushing 710, and the bolt probe 608 may be moved toward the gas power source adapter 214 by a portion of the gas, causing the gun to cock. Once the pressure in the probe transfer port 802 dissipates, the main spring 304 may drive the bolt assembly 306 back into its original position and the bolt lock spring 708 may rotate the bolt lock bushing 710 to its original position and the cam pin 704 into a position low in the lock notch 408. The bolt lock regulator spring 810 may bias the bolt lock regulator poppet 806 into a closed position, thereby sealing off the probe transfer port 802 once the bolt lock regulator body 706 is in a predetermined position. In an embodiment, the bolt lock regulator adjustment screw 812 may be used to adjust the bias force from the bolt lock regulator spring 810 on the bolt lock regulator poppet 806. Such adjustments may control the amount of pressure in the probe transfer port 802 required to open the bolt lock regulator poppet 806.

FIG. 9 is a perspective view diagram illustrating one embodiment of a gas distribution block assembly 310 of an efficient high-velocity compressed gas-powered gun 100. In an embodiment, the gas distribution assembly 310 may include a distribution block body 902, which may house gas distribution valves and gas transfer tubes. In an embodiment, the distribution block body 902 may include a barrel port 904 configured to receive barrel 106. In some embodiments, the barrel port 904 may be threaded or grooved to retain the barrel 106 within the barrel port 904. In an embodiment, the distribution block body 902 may also include a transfer tube port 906. The transfer tube port 906 may transfer a portion of the gas distributed to the bolt assembly 306 for actuation of the bolt regulator body 706. Additionally, the distribution block body 902 may include a valve stem 908 for receiving gas to actuate valves within the distribution assembly 310.

FIG. 10 is a cross-section view diagram illustrating one embodiment of a gas distribution block assembly 310 of an efficient high-velocity compressed gas-powered gun 100. In an embodiment, the assembly may include the valve stem 908 and a transfer tube inlet port 906. The valve stem 908 may actuate a valve poppet 1010 allowing high pressure gas to be injected through the high pressure access port 1006. In an embodiment, the valve assembly, including the valve poppet 1010 may be accessible via the high pressure port plug 1012.

In an embodiment, the barrel retention setscrew 1002 may retain the barrel 106 within the barrel port 906. A distribution block anchor screw hole 1014 may be configured to receive a screw for holding the distribution assembly 310 within the upper receiver 104.

FIG. 11 is a side view diagram illustrating one embodiment of a trigger assembly 302 of an efficient high-velocity compressed gas-powered gun 100. In an embodiment, the trigger assembly 302 may include a trigger lever 204 and a fire mode and safety selector switch 206 as described above with reference to FIG. 2. In a further embodiment, the trigger assembly 302 may include a valve striker 1108 coupled to the striker spring 1128. The striker spring 1128 may be coupled to a striker spring guide 1126. In an embodiment, the fire mode and safety selector switch 206 may be coupled to a selector spring 1124. The selector switch 206 may be retained in position by a selector detent 1122. In an embodiment, the trigger assembly 302 may include one or more sear components. For example, the trigger assembly 302 may include a drop sear 1106, a shelf sear 1104, an auto sear 1110, or the like. Additionally, the sears may be coupled to sear springs. For example, the auto sear 1110 may be coupled to an auto sear spring 1114, the shelf sear 1104 may be coupled to a shelf sear spring 1116, and the drop sear 1106 may be coupled to a drop sear spring 1120. Further, the trigger assembly 306 may include one or more auto actuators 1102. The auto actuators may be coupled to the trigger 204 via an actuator link pin 1112. The trigger 204 may also be coupled to a trigger torsion spring 1118. The various springs may be used to bias each sear and the trigger 204 into predetermined positions.

In an embodiment, the drop sear 1106 holds the valve striker 1108 back, under spring tension when it's cocked. When the trigger 204 is pulled, the drop sear 1106 releases the valve striker 1108 and the valve striker 1108 strikes the valve stem 908, firing the rifle. In a semi-automatic mode, the auto sear 1110 engages when the drop sear 1106 is pulled. In such an embodiment, when the drop sear 1106 is pulled and the valve striker 1108 is released, the valve striker 1108 strikes the valve stem 908, and when the piston system moves the valve striker 1108 backwards in an effort to cock it, the auto sear 1110 engages, and holds the valve striker 1108 in place until the drop sear 1106 is reset (i.e. the user lets go of the trigger 206).

In an embodiment, the selector switch 206 is similar to an AR-15 type selector. For example, the selector switch 206 may operate as both a safety system and fire mode selection switch. It may include a series of half slots so that when turned or oriented in a certain way it can block the travel of the shelf sear 1104 to act as a safety, or raise up and engage/disengage the automatic fire linkage to act as a fire mode selector. In an embodiment, the selector switch fits the same form factor as a Mil-Spec M4/M16.

In an embodiment, the valve striker 1108 acts as a "hammer" of the trigger action. The valve striker 1108 may be held back under pressure from the striker spring 1128. When the trigger 204 is pulled the valve striker 1108 is freed and strikes the valve stem 908 with great force, allowing the valve poppet 1010 to momentarily open and cause the airgun 100 to discharge its projectile.

In an embodiment, the drop sear 1106 may hold the valve striker 1108 in place against the mainspring pressure and release the valve striker 1108 when the action is fired. The drop sear 1106 may hold all of the striker spring tension in its locator pin so the sear itself is easily tripped, hence requiring very little force to trigger the much larger striker spring force. In an embodiment, the drop sear's pivot point may be slotted around the locator pin to allow for front to rear movement of about 0.15 in. The drop sear 1106 may also have a drop sear spring 1120 that allows this sliding movement to happen automatically. The front portion of the drop sear 1106 may have a geometry that allows the auto sear 1110 to "catch" it and hold it until the trigger 204 is released or the bolt locks full forward for automatic fire mode.

In an embodiment, the shelf sear 1104 holds up the drop sear 1106 when the action is armed and releases the drop sear 1106 when the trigger 204 is pulled. The shelf sear 1104 may include a shelf sear spring 1116 on its front end pushing up and providing resistance to the lever. The shelf sear 1104 may also be configured such that the selector switch 206, when is safe mode, will impede its travel rendering the action un fire-able.

In an embodiment, the auto sear 1110 may move forward and backward against the auto sear spring 1114. In such an embodiment, the auto sear 1110 may catch and hold the drop sear 1106 during the setting and resetting of the action after firing. In semiautomatic mode, the auto sear 1110 may release the drop sear 1106 when the trigger 204 is released by the shooter, allowing the shelf sear 1104 to get into a position to catch the drop sear 1106, preventing the gun 100 from runaway firing.

In an embodiment, the auto actuators 1102 may be linked to the movement of the trigger 204 such that when the trigger 204 is pulled they allow the auto sear 1110 to move into a position so it can catch the drop sear 1106 after the action has been fired. When the trigger 204 is released the auto actuators 1102 may move the auto sear 1110 into a position that allows the drop sear 1106 to be released only when the shelf sear 1104 is in a place to catch the drop sear 1106.

In an embodiment, the trigger 204 is the part the shooter touches and controls the firing of the weapon. When the trigger 204 is pulled its rearward end travels upwards and acts on the rearward end of the shelf sear 1104, thus firing the weapon. The trigger 204 may have a torsion spring 1118 that provides resistance on the trigger 204.

In an embodiment, the trigger assembly 302 may be operated by a shooter by pulling the trigger 204. In such an embodiment, when the trigger is pulled rearwards by the shooter, the rear part of the trigger 204 moves upwards acting on the rear portion of the shelf sear 1104. The auto actuators 1102 may move in sequence with the trigger 204 to position the auto sear 1110. The trigger 204 may be pulled far enough back so that the "shelf portion" of the shelf sear 1104 no longer supports the drop sear 1106 and the drop sear 1106 falls downwards releasing the valve striker 1108.

Upon release of the valve striker 1108, the drop sear spring 1120 can now act on the drop sear 1106 pulling it rearwards a measured amount and also drawing the rear of the drop sear down 1106 and the front of it upwards, resting the catch on the auto sear 1110. As the valve striker 1108 slams forward under mainspring pressure, the valve may fire. The action cycles and the valve striker 1108 is pushed back by the bolt assembly 306. As the valve striker 1108 pushes over the drop sear 1106 its front portion is allowed to travel down and out of the way so the sear portion can once again be engaged by the valve striker 1108. The main spring force may then take over and the valve striker 1108 may begin moving forward, driving the drop sear pivot point to the forward part of the slot and finally allowing the drop sear 1106 catch to rest on the auto sear 1110.

In semi-automatic mode, the action may stay in this orientation until the trigger 204 is released by the shooter, causing the auto sear 1110 to move rearwards via the auto actuators 1102 and thereby allowing the drop sear 1106 to come to rest on the shelf sear 1104. The action has now been reset and is ready to fire again. In full auto mode, the auto sear 1110 is pushed forward by connection linkage when the bolt is full forward and locked, thereby releasing the drop sear 1106 fully and allowing the valve striker 1108 to release, cycling the weapon until the trigger 204 is released.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

The invention claimed is:

1. An efficient high-velocity compressed gas-powered gun, comprising:

a lower receiver having a trigger assembly;

an upper receiver having:

a gas distribution assembly;

a bolt assembly configured to operate in response to actuation of the trigger assembly and configured to be operated by the gas distribution system, the bolt assembly having:

a first part and a second part that:

are separated by a small gap just prior to actuation of the trigger assembly, and become separated by a large gap, larger than the small gap, over a projectile-firing period of time immediately after the trigger assembly is actuated, the increase in the gap size being caused by movement of the second part in response to gas entering the small gap from the gas distribution assembly;

wherein the first part and the second part move together to cock the gun once they are separated by the large gap and wherein the second part comprises:

a bolt probe;

a bolt lock regulator body coaxial to and fixedly coupled to the bolt probe;

a bolt lock bushing coaxial to and laterally fixed to the bolt probe and rotatable about the bolt probe; and a torsion spring coupled between the bolt lock regulator body and the bolt lock bushing that biases the bolt lock bushing to rotate about the bolt probe.

2. The gas powered gun of claim 1, wherein the first part comprises a bolt lock piston and a recoil buffer coupled to the bolt lock piston.

3. The gas powered gun of claim 1, wherein the upper receiver further comprises a cylindrical bolt carrier fixedly coupled to the bolt lock piston, the cylindrical bolt carrier having an L-shaped cam slot, the L-shaped cam slot having a short leg connected to a long leg at a junction, the cylindrical bolt carrier containing the bolt lock regulator body, the bolt lock bushing, and the bolt probe.

4. The gas powered gun of claim 3, further comprising a cam pin coupled to the bolt lock bushing and engaged with the L-shaped cam slot of the cylindrical bolt carrier, the cam pin being biased by the torsion spring interaction between the bolt lock bushing and the bolt lock regulator body into the short leg of the cam slot away from the junction, such that movement of the bolt lock piston and the bolt carrier in a direction to increase the gap from the small gap to the large gap causes the cam pin to move within the L-shaped cam slot toward the junction and into the long leg.

5. The gas powered gun of claim 4, wherein upon firing the projectile from the gun, the cam pin moves within the L-shaped cam slot toward the junction and into the short leg under bias from the torsion spring.

6. The gas powered gun of claim 4, wherein movement of the cam pin within the L-shaped cam slot into the long leg causes the gun to cock.

7. The gas powered gun of claim 3, wherein the bolt probe is coupled to a source of pressurized gas at one end and to a poppet valve within the bolt lock regulator body at the other end, the poppet valve separating a pressurized chamber in the bolt lock regulator body from a pressurizable chamber in the bolt lock regulator body.

8. The gas powered gun of claim 7, wherein the poppet valve comprises a spring and a hollow set screw, wherein rotation of the hollow set screw adjusts a tension in the spring and a pressure required to open the poppet valve so that the pressurized chamber communicates with the unpressurized chamber.

9. The gas powered gun of claim 8, wherein the hollow set screw provides gaseous communication from the pressurizable chamber to the gap between the bolt lock regulator body and the bolt lock piston.

10. A method comprising:

directing compressed gas through a bolt probe to a poppet valve;

opening the poppet valve by the pressure of the compressed gas;

releasing the compressed gas through the poppet valve into a gap between a first part and a second part, wherein the first part is contained by a carrier and the second part is contained by the carrier and coupled to the bolt probe;

increasing, by action of the compressed gas into the gap, a size of the gap from a small gap to a large gap over a projectile-firing period of time;

moving the first part and the carrier relative to a third part, wherein:

the third part is rotatably coupled to the bolt probe and coupled to the second part by a torsion spring, the third part has a cam pin that engages with a cam lock slot in the carrier, movement of the carrier relative to the third part causes the third part to rotate, the rotation being resisted by the torsion spring, and rotation of the third part causes the cam pin to move within the cam lock slot to a location where the first part, the second part, and the third part can translate relative to the carrier in a gun-cocking direction after the projectile-firing period of time.

11. The method of claim 10 further comprising:

compressing a spring by movement of the first part, the second part, and the third part in the gun-cocking direction;

decompressing the spring to move the first part, the second part, and the third part in a bolt-locking direction, wherein the bolt-locking direction is opposite the gun-cocking direction; and moving, as a result of movement of the third part in the bolt-locking direction, the cam pin within the cam lock slot until the torsion spring causes the third part to rotate under the influence of the torsion spring, which causes the cam pin to move in the cam lock slot into a bolt lock position.

12. The method of claim 10 further comprising:

firing a projectile using the compressed gas during the projectile-firing period of time.

13. A bolt assembly for a gun comprising:

a first part and a second part that:

are separated by a small gap just prior to actuation, and become separated by a large gap, larger than the small gap, over a projectile-firing period of time immediately after actuation, the increase in the gap size being caused by movement of the second part in response to gas entering the small gap;

wherein the first part and the second part move together to cock the gun once they are separated by the large gap; and wherein the second part comprises:

a bolt probe;

a bolt lock regulator body coaxial to and fixedly coupled to the bolt probe;

a bolt lock bushing coaxial to and laterally fixed to the bolt probe and rotatable about the bolt probe; and a torsion spring coupled between the bolt lock regulator body and the bolt lock bushing that biases the bolt lock bushing to rotate about the bolt probe.

14. The bolt assembly of claim 13, wherein the first part comprises a bolt lock piston and a recoil buffer coupled to the bolt lock piston.

15. The bolt assembly of claim 13, wherein the upper receiver further comprises a cylindrical bolt carrier fixedly coupled to the bolt lock piston, the cylindrical bolt carrier having an L-shaped cam slot, the L-shaped cam slot having a short leg connected to a long leg at a junction, the cylindrical bolt carrier containing the bolt lock regulator body, the bolt lock bushing, and the bolt probe.

16. The bolt assembly of claim 15, further comprising a cam pin coupled to the bolt lock bushing and engaged with the L-shaped cam slot of the cylindrical bolt carrier, the cam pin being biased by the torsion spring interaction between the bolt lock bushing and the bolt lock regulator body into the short leg of the cam slot away from the junction, such that movement of the bolt lock piston and the bolt carrier in a direction to increase the gap from the small gap to the large gap causes the cam pin to move within the L-shaped cam slot toward the junction and into the long leg.

17. The bolt assembly of claim 16, wherein upon firing the projectile from the gun, the cam pin moves within the L-shaped cam slot toward the junction and into the short leg under bias from the torsion spring.

18. The bolt assembly of claim 17, wherein movement of the cam pin within the L-shaped cam slot into the long leg causes the gun to cock.

19. The bolt assembly of claim 15, wherein the bolt probe is coupled to a source of pressurized gas at one end and to a poppet valve within the bolt lock regulator body at the other end, the poppet valve separating a pressurized chamber in the bolt lock regulator body from a pressurizable chamber in the bolt lock regulator body.

20. The bolt assembly of claim 19, wherein the poppet valve comprises a spring and a hollow set screw, wherein rotation of the hollow set screw adjusts a tension in the spring and a pressure required to open the poppet valve so that the pressurized chamber communicates with the unpressurized chamber.

21. The bolt assembly of claim 20, wherein the hollow set screw provides gaseous communication from the pressurizable chamber to the gap between the bolt lock regulator body and the bolt lock piston.

* * * * *